US005310290A

United States Patent [19]

Spencer

[11] Patent Number: 5,310,290

[45] Date of Patent: May 10, 1994

[54] PROTECTIVE STRUCTURE FOR EXCAVATIONS

[76] Inventor: Dennis I. Spencer, 12140 E. 116th Cir., Henderson, Colo. 80640

[21] Appl. No.: 30,788

[22] Filed: Mar. 12, 1993

[51] Int. Cl.[5] ..... E02D 3/02; E02D 5/00

[52] U.S. Cl. ..... 405/283; 405/282; 405/273

[58] Field of Search ..... 405/282, 283, 272, 273

[56] References Cited

U.S. PATENT DOCUMENTS

| | | | |
|---|---|---|---|
| 2,865,178 | 12/1958 | Wicke | 405/283 |
| 3,295,330 | 1/1967 | Meshorer | 405/282 |
| 3,362,168 | 1/1968 | Dotlich | 405/283 |
| 3,614,870 | 10/1971 | Boynton | 405/273 |
| 3,788,086 | 1/1974 | West | 405/283 |
| 3,851,856 | 12/1974 | Berg | 405/282 X |
| 4,056,938 | 11/1977 | Griswold | 405/283 |
| 4,090,365 | 5/1978 | Nieber . | |
| 4,114,383 | 9/1978 | Nieber . | |
| 4,202,649 | 5/1980 | Cook et al. . | |
| 4,259,028 | 3/1981 | Cook . | |
| 4,682,914 | 7/1987 | Aihara et al. | 405/283 |
| 4,993,880 | 2/1991 | Collins | 405/282 X |

FOREIGN PATENT DOCUMENTS

| | | | |
|---|---|---|---|
| 2115857 | 9/1983 | United Kingdom | 405/283 |

OTHER PUBLICATIONS

"World Class Leadership" published by Efficiency Production, Inc.

"Efficiency Build-A-Box" published by Efficiency Production, Inc. dated 1992.

"Bil-Jax" published by Trench Shoring.

"Shoring International" published Shoring International dated 1990.

"GME The Trench Shield Specialist" published by Griswold Machine and Engineering dated 1992.

"Speed Shore" published by Speed Shore Corporation dated 1990.

"This is a COMCORE Roadplate" published by Utilities Product, Inc.

*Primary Examiner*—Dennis L. Taylor

*Attorney, Agent, or Firm*—Timothy J. Martin

[57] ABSTRACT

A protective panel may be used alone or paired to form a protective structure to provide a protected space in an excavation by buttressing the upright walls of the excavation. The protective panel is constructed of a corrugated aluminum sheet that has alternating, oppositely opening, longitudinal channels. The end edges and the lateral edges of the sheet are rigidified respectively by a transverse and longitudinal rigidifying members. Mounting stations are located on one side of the protective panel and are formed by transverse support plates that extend across the top of a selected channel and that are reinforced by gusset webs to create a beam section. A brace assembly may mount to the mounting station and may support the protective panel against an upright excavation wall; preferably, however, a pair of opposed protective panels are interconnected and retained apart by a plurality of spreader beams extending between opposed mounting stations to create a protective structure in the form of a trench box. The protective structure may be supported by leg members that telescope into the transverse rigidifying members. Alternatively, the protective structure may be suspended from a wheeled carriage. A plurality of protective structures may be stacked and retained by interconnect pins. The protective panels may include inwardly oriented handles. An optional end panel with a specially configured latch structure is disclosed, and optional mounting stations and spreader beams are described.

30 Claims, 6 Drawing Sheets

PROTECTIVE STRUCTURE FOR EXCAVATIONS

FIELD OF THE INVENTION

The present invention relates to protective structures adapted to be used in excavations in order to buttress the upright sidewalls thereof. For example, the present invention may be employed to support the upright opposed sidewalls of trenches, manholes and other excavations in order to reduce the danger of sidewall collapse and the corresponding risk of injury to a worker situated within the excavation. Particularly, the present invention is directed to a protective structure that has a high strength to weight ratio.

BACKGROUND OF THE INVENTION

The construction industry often desires to employ excavations of various types, such as foundations, trenches, and the like. Where excavations are made in the earth, it is desirable to support the upright sidewalls of the excavation against collapse or to protect a sheltered work space in the event of collapse. While naturally the collapse of the sidewall will increase the costs of a project by requiring reexcavation, of greater concern is the potential danger of injury or death to workers construction project who are situated within the excavation. So great is the concern for worker safety, that some governmental agencies have promulgated regulations directed to the manner in which excavations are created and the structures used to support the excavations against sidewall collapse. The present invention is directed to laterally supporting the sidewalls of excavations, in general, and trenches, in particular and protecting in the event of collapse of unsupported excavation sidewalls. Technically, the positive supporting of a sidewall in this field is called "shoring" while the protection against collapse is called "shielding". These two possible implementations of the present invention may be jointly referred to as "buttressing", since, in some applications it may be desirable to employ the protective panel and shield system to shore an excavation sidewall, and in other applications it may be desirable to provide a shielded space in the event of collapse.

The desirability of supporting the sidewall of an excavation has long been known. Early structures used to buttress earthen sidewalls includes upright stone and wooden retaining walls, either alone or in combination with braces which extend between the retaining wall and a horizontal surface. These retaining walls, with or without the associated braces, resist lateral forces which tend to collapse or cause a cave-in of the sidewall.

Subsequently, shoring systems were developed wherein a plurality of upright sheeting members were placed against the sidewall of an excavation and were held in place by horizontal wales that were in turn braced either against the bottom of the excavation or, in trenching applications, against the opposed sidewall. Even more recently, prefabricated shoring systems usually referred to as "trench boxes" or "trench shields" have been manufactured for use in a variety of trenching or excavation applications.

One example of such a prefabricated trench box is shown in U.S. Pat. No. 4,090,365 issued May 23, 1978 to Nieber. In this structure, stackable side panels are outwardly disposed against an excavation and are cross-braced to prevent collapse of the trench. A portal frame is attached to the open end of the trench box in the form of an arch allowing clearance for a pipe to be laid in the trench. U.S. Pat. No. 4,202,649 issued May 13, 1980 to Cook et al. shows another trench box having a specially configured front plate. U.S. Pat. No. 4,259,028 issued Mar. 31, 1981 to Cook discloses a specially constructed trench box panel comprising a light-weight foam filler located between inner and outer panel surfaces in order to reduce weight and prevent leakage.

Despite the shoring structures developed in the past, several problems remain in virtually all such premanufactured assemblies. Primary among these problems is the low strength-to-weight ratio of the assemblies. That is, in order to obtain sufficient shoring strengths, fairly heavy support members, typically fabricated of steel, are used in structure. Due to the weight of these construction materials, the resulting trench boxes are unwieldy to insert and remove from the trench or excavation and often require the use of lifting machinery to manipulate the trench box. Furthermore, due to the weight of these structures, there is always an inherent danger of injury to a worker in the vicinity of the box during transport or positioning; repositioning or placement of such trench boxes is also very time consuming.

Accordingly, there remains a need for improved excavation shields and trench boxes which exhibit a high strength-to-weight ratio while providing adequate clearance for workers and equipment within an excavation. There is a further need for such shoring systems which are versatile and adaptable to a variety of buttressing needs and yet which are fast and easy to use without substantial risk or injury to the construction workers. The present invention is directed to meeting these needs, as described below.

SUMMARY OF THE INVENTION

It is an object of the present invention to provide a new and useful protective panel adapted to be braced against the upright wall of an excavation in order to shore the upright wall against collapse and/or provide a shielded space.

It is a further object of the present invention to provide protective panels which may be used as an opposed pair to form a trench box in order to buttress the opposed uprights of an excavation.

Another object of the present invention is to provide a protective panel and protective structure system that has a high strength-to-weight ratio.

Yet another object of the present invention is to provide a protective panel and shield structure constructed of materials having a light enough weight so that they may be easy to use by a construction worker yet which are strong enough to adequately protect the construction workers who are performing tasks in the excavation.

Still another object of the present invention is to provide a shoring panel for use in a protective structure that is highly versatile so as to be adaptable to a variety of shoring needs and that may be supported in the excavation in a variety of manners.

Another object of the present invention is to provide a protective structure configured so that a plurality of such structures may be stackable.

Yet another object of the present invention is to provide a protective structure which may completely surround a protected space.

Another object of the present invention is to provide a protective structure configured to provide adequate clearance for piping and other mechanical devices located within an excavation so that a worker may perform tasks on the mechanical structure in a protected environment.

To accomplish these objects, the present invention is directed to a new and useful protective panel that is adapted to be braced in order to buttress an upright wall of an excavation. Preferably, a pair of protective panels are placed in opposed relation to buttress the opposed upright walls of an excavation, such as a trench, manhole, and the like, in order to provide a protected environment. Each protective panel is preferably constructed of aluminum to provide a high strength-to-weight ratio so that it will adequately protect the worker yet so that it will be quickly and easily manipulated into and out of position in an excavation.

The protective panel according to the present invention is formed as a corrugated sheet having lateral side edges and a pair of end edges. This sheet is configured in a plurality of channels extending longitudinally between the end edges thereof with alternate ones of the channels opening oppositely and with each channel having a bottom wall and a pair of sidewalls. Thus, adjacent ones of the channels have a common sidewall therebetween. A transverse rigidifying member is secured along each end edge of the corrugated sheet, and at least one mounting station is disposed on a first side of the sheet. The mounting station is operative to mount the brace whereby the protective panel may be supported with a second side against the upright wall of the excavation. The mounting station includes a support plate that extends transversely across a selected channel and at least one gusset web that is interposed between the support plate and the bottom wall of the selected channel so as to support the support plate against the bottom wall. Preferably, a plurality of mounting stations are disposed on the first side of the sheet.

Where a pair of protective panels are used, they are adapted to be placed in opposed relationship to one another so that the mounting stations are also in an opposed relationship. A plurality of spreader beams are then provided with these spreader beams adapted to extend between the opposed mounting stations so as to retain the protective panels in spaced-apart relation against the opposed upright walls of the excavation. These spreader beams may be of a single length, or may be manually adjustable in length or mechanically adjusted, for example, by air or hydraulic actuation.

In any event, it is preferred that the protective panels of the present invention have handle structures disposed on the first or facing sides thereof in order to allow a worker to manipulate the protective panel (and the resulting protective structure when two such panels are connected). Furthermore, it is preferred that the transverse rigidifying member of each protective panel be tubular so that it can receive adapters for different support assemblies. For example, leg members may be telescopically received and pinned within the rigidifying members so that the protective panels may be elevated above a support surface. Alternatively, innerconnect pins may be telescopically received in the rigidifying members so that a pair of protective panels or a pair of protective structures may be stacked, one on top of the other. Furthermore, in the protective structure configuration, a carriage assembly, including axle supports and wheels may be pinned within the transverse rigidifying members so that the protective structure may be suspended into the excavation from the ground surface.

Alternative mounting stations are disclosed in this invention. Here, a connecting piece may be secured the respective support plate of each mounting station, and this connecting piece can either be releasable or permanently affixed. In one embodiment, the connecting piece includes a base plate and a socket, and the base plates are releasably connectable to the support plates so that the sockets inwardly face one another for connection to the spreader beams. Alternatively, the connecting pieces may be adapter plates which have slideways sized and configured to slideably receive an end portion of the spreader beam or to slideably receive an auxiliary socket piece having a base plate and socket structure.

End panels may be provided to enclose an open end of the protective structure. Here, the end panels include latch assemblies having latch bars configured to engage a selected facing channels on the protective panels so that the side webs thereof retain the end panel in position transversely with respect to the protective panels. The latch bars may be pivotally mounted so that they may pivot into and out of engagement with the inwardly facing channels. Furthermore, the latch bars are spring biased into the engagement position.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is directed to apparatus operative to buttress, i.e., shore or shielded, the upright sidewalls of excavations and encompasses both a protective panel adapted to be supported against the upright wall of the excavation and, more specifically, to be incorporated into a shield protective or "trench box" assembly that may be positioned in a trench, manhole or other such similar excavation in order to buttress opposed upright walls thereof. As will be more fully appreciated upon a review of this complete disclosure, the present invention provides an extremely useful and versatile protective structure having a high strength-to-weight ratio so that it may be easily manipulated by a worker without the need for industrial machinery and which may be easily inserted and removed from an excavation.

Figure 1:
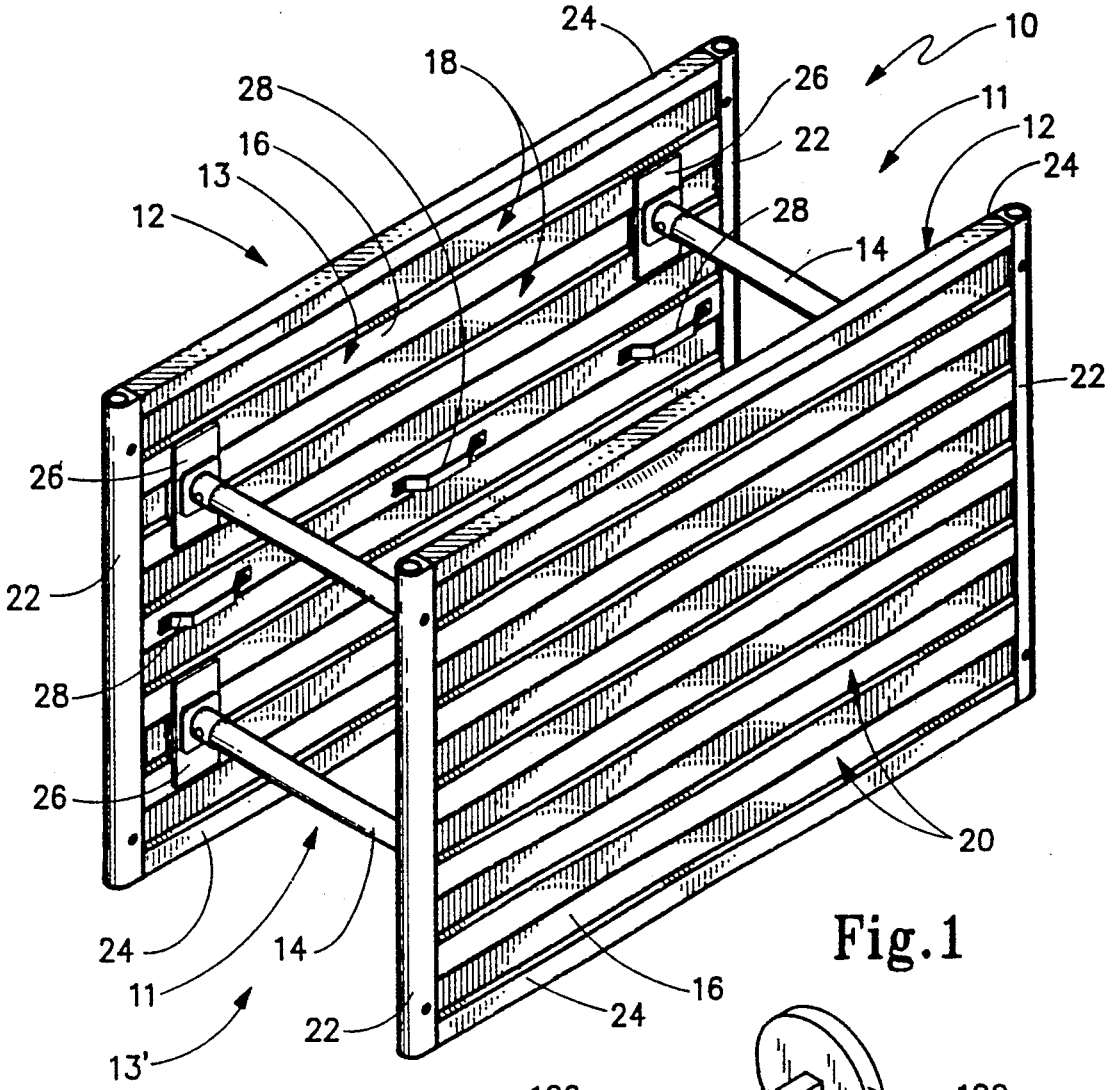
FIG. 1 is a perspective view of a protective structure according to a first exemplary embodiment of the present invention incorporating a pair of protective panels and interconnecting spreader beams.

The protective structure according to a first exemplary embodiment of the present invention is shown in FIG. 1 where it may be seen that protective structure 10 is formed by a pair of protective panels 12 which are placed in opposed relation and held in position by means of a plurality of spreader beams 14. Protective structure 10 has a pair of open ends 11, an open top 13 and an open bottom 13'. As described more thoroughly below, each protective panel 12 is formed by a corrugated sheet 16 of metal, preferably aluminum such as 0.10 inch (0.25 cm) sheet, so that each sheet 16 has a plurality of longitudinally extending, inwardly facing channels 18 and a plurality of longitudinally extending, outwardly facing channels 20. Each sheet 16 is further rigidified, along its transverse end edges, by means of transverse rigidifying members 22, and along its lateral side edges by means of longitudinal rigidifying members 24. Rigidifying members 22 and 24 are also preferably fabricated of extruded aluminum. Spreader beams 14 extend between mounting stations 26 located on the inwardly facing sides of each protective panel 12, and a plurality of handles 28 are likewise provide on the inwardly facing sides of the protective panels 12.

The construction of protective panels 12 may best be seen with reference to FIGS. 2–5. Here, it may be seen that each of channels 18 and 20 are formed by a bottom wall 30 and a pair of sidewalls 32 that are each formed at an obtuse angle with respect to bottom wall 30. It should furthermore be appreciated that the alternate ones of channels 18 and 20 have a common sidewall 32 therebetween.

Figure 3:
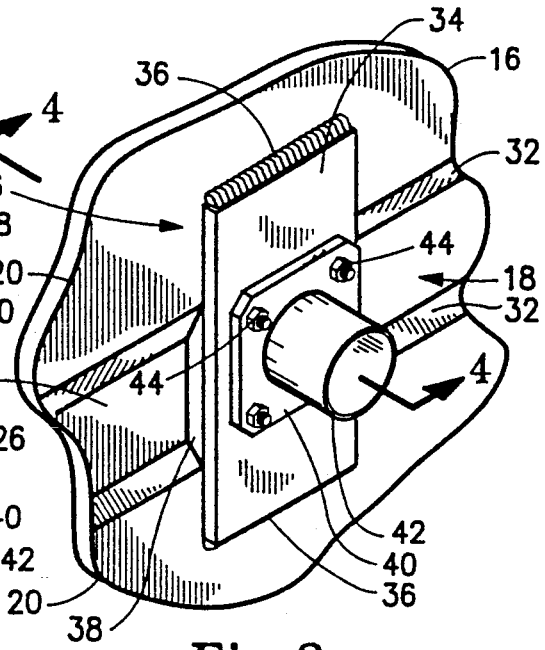
FIG. 3 is a perspective view of a spreader beam mounting station on the protective panel of FIGS. 1 and 2.
Figure 5:
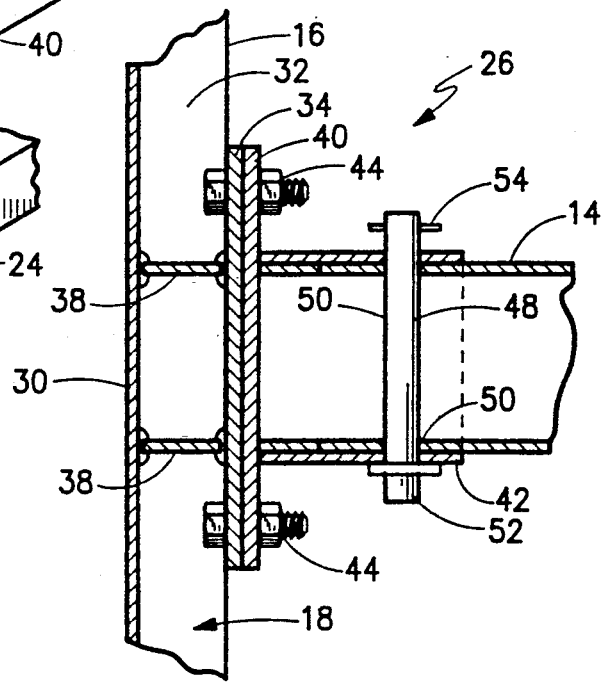
FIG. 5 is a cross-section view taken about lines 5—5 FIG. 4.
Figure 4:
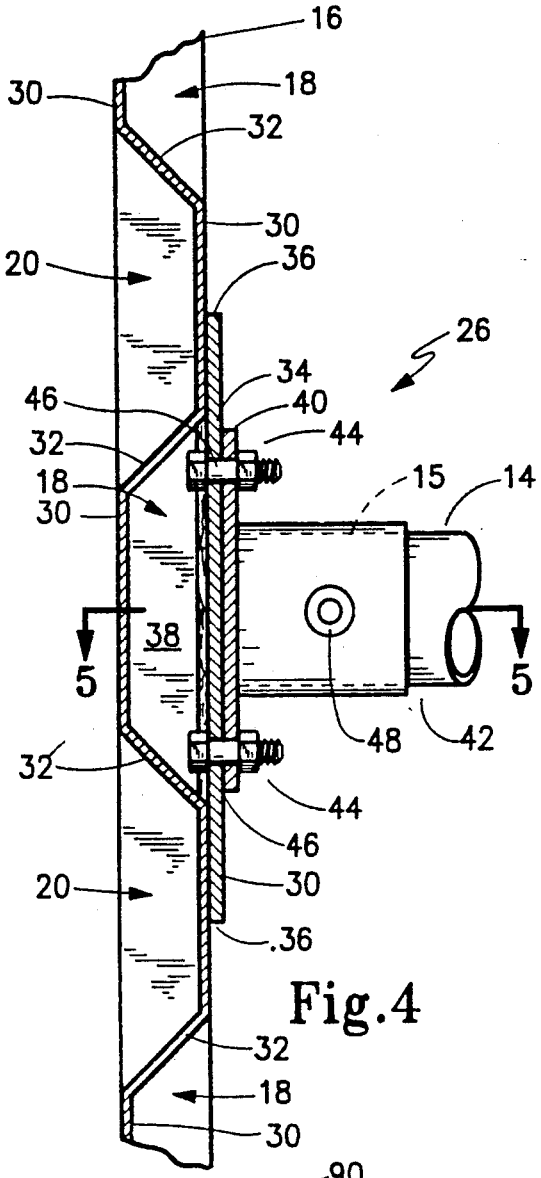
FIG. 4 is a cross-sectional view taken about lines 4—4 of FIG. 3.

Each mounting station 26, as is best shown in FIGS. 3–5 is structured by a support plate 34 that extends transversely across a selected channel, such as a selected inwardly facing channel 18. Support plate 34 is thus in spaced relationship with the bottom wall 30 of the selected channel 18 and is secured, such as by weldments 36, to the bottom walls 30 of the adjacent channels 20. A pair of trapezoidal gusset webs 38 are welded perpendicularly to both bottom wall 30 and support plate 34 and parallel to one another. In this manner, support plate 34 is supported against the bottom wall 30 of the selected inwardly facing channel 18, and this structure creates a beam section for each mounting station 26.

With reference again to FIGS. 1–5, it may be seen that each mounting station 26 further includes a connecting piece allowing a respective end portion 15 of a spreader beam 14 to be secured to mounting station 26. In the embodiment shown in FIGS. 2–5, this connecting piece is in the form of a base plate 40 and a socket 42 with socket 42 adapted to matably receive end portion 15 of spreader beam 14. Socket 42 is rigidly attached to base plate 40 which, in turn, is releasably securable to port plate 34 by means of a plurality of nut and bolt sets 44. Accordingly, base plate 40 and support plate 34 have alignable mounting holes 46 through which the bolts of nut and bolt sets 44 extend. When end portion 15 of the spreader beam 14 is inserted into socket 42, it may be retained in position by means of a retaining pin 48 that is received through aligned diametric bores 50 respectively formed in end portion 15 of spreader beam 14 and socket 42. Retaining pin 48 has an enlarged head 52 and may, itself, be retained in position by means of pin element 54.

Figure 2:
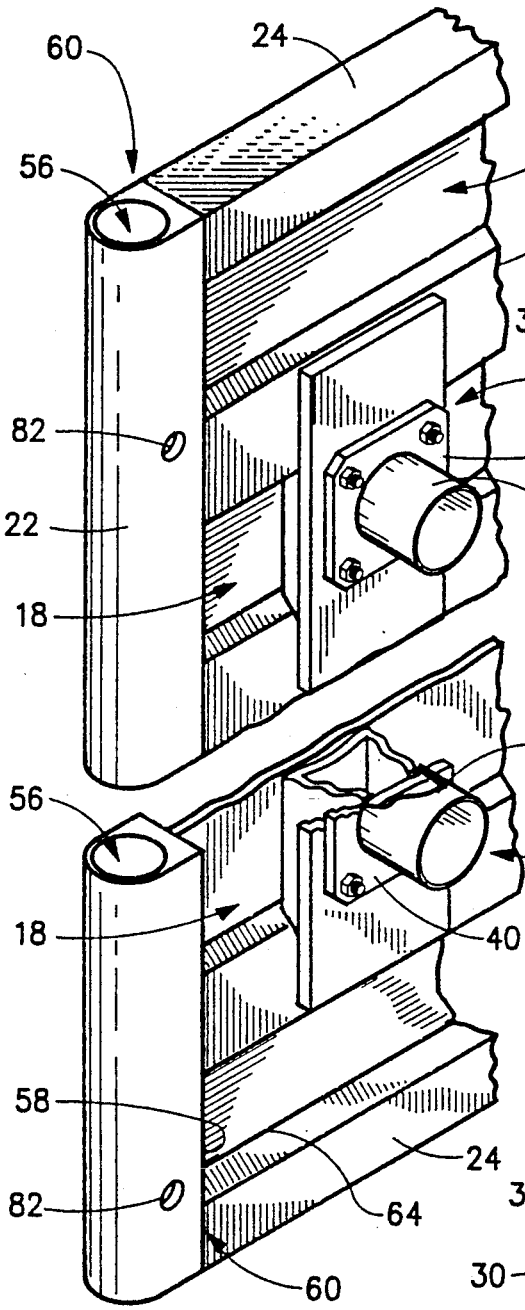
FIG. 2 is a perspective view, partially broken away, of an end portion of a protective panel according to the preferred embodiment of the present invention.

With reference again to FIG. 2, it may be seen that each transverse rigidifying member 22 is tubular in shape and is preferably D-shaped in cross-section. Thus, rigidifying member 22 has a cylindrical passageway 56 extending axially therethrough. Each end edge of sheet 16, such as end edge 58, is welded to D-shaped transverse rigidifying member 22 along its length, and this construction helps rigidify sheet 16 against unwanted bending or deflection. Each protective panel 12 is further framed by means of longitudinal rigidifying members 22 which are preferably in the form of square-shaped tubes, as is shown in FIG. 2. Rigidifying members 22 and 24 are rigidly attached, such as by welding, at corners 60 so that each longitudinal rigidifying member 24 extends along a lateral edge 62 of sheet 16 between a pair of longitudinally adjacent corner 60 while each rigidifying member 22 extends transversely of sheet 16 between transversely adjacent corners 60. It should be appreciated that transverse rigidifying members 24 may be attached, such as by welding, to the bottom walls 30 of the outermost ones of channels 18, 20.

Figure 6:
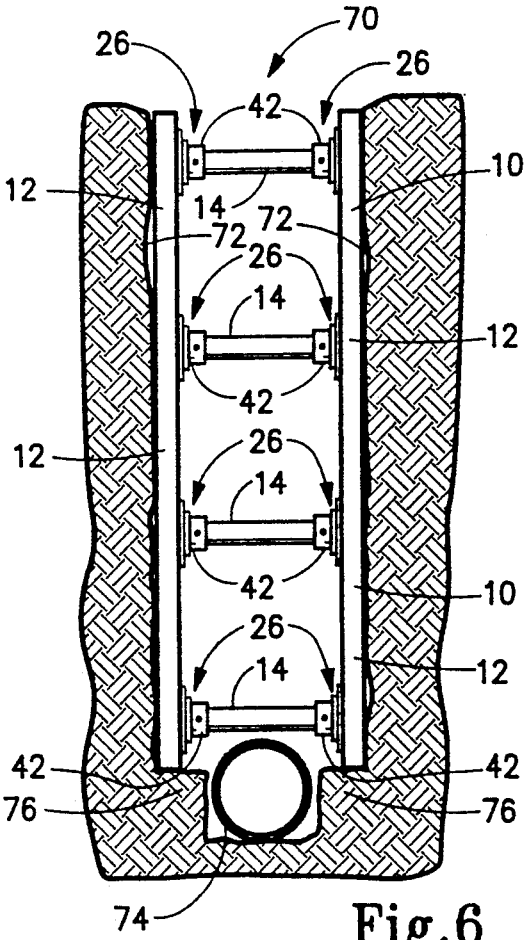
FIG. 6 is an end view in elevation showing a pair of protective structures, of the type shown in FIG. 1, mounted within a trench.

With reference to FIGS. 1 and 6, it may now be seen that a protective structure 10 may be used to buttress the opposed upright walls of an excavation. In FIG. 6, a pair of protective structures 10 are employed in excavation with protective structures 10 being stacked, one on top of the other. In FIG. 6, it may be seen that the excavation is in the form of a trench 70 having opposed upright walls 72. Trench 70 is excavated to receive a pipe 74 which is located between a pair of benches 76 formed along the lowermost portion of trench 70. Thus, a pair of stacked protective structures 10 are supported on benches 76 so that adequate clearance for pipe 74 is maintained.

Figure 7:
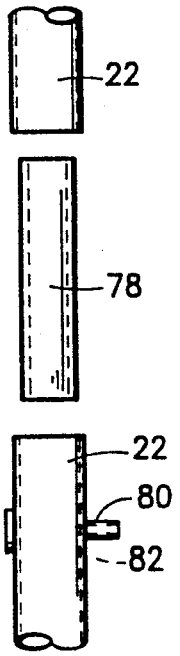
FIG. 7 is an exploded side view in elevation showing the interconnect pin used to interconnect a pair of protective structures.

In FIG. 6, it may be seen that protective panels 12 of each protective structure 10 are positioned so that that first sides thereof are in opposed relation to one another while the second sides are alongside upright walls 72. When protective panels 12 are opposed to one another, mounting stations 26 are likewise in opposed facing relation so that spreader beams 14 may be mounted in sockets 42 thereby to retain the protective panels 12 against wall 72. In order to keep protective structures 10 from becoming dislodged, when in a stacked array, interconnect pins 78 are provided to telescopically extend into cylindrical passageways 56 at the abutting ends of transverse rigidifying members 22, as is shown best in FIG. 7. Interconnect pin 78 are simply tubular pieces having an outer diameter of slightly smaller than the inner diameter passageway 56. In order to keep each interconnect pins 78 from longitudinally through passageway 56, a keeper pin 80 extends diametrically through the lower rigidifying member 22 at a location proximate to its upper end. Accordingly, the opposite ends of each rigidifying member 22 is provided with diametric holes 82, as is shown in FIG. 2.

Figure 9:
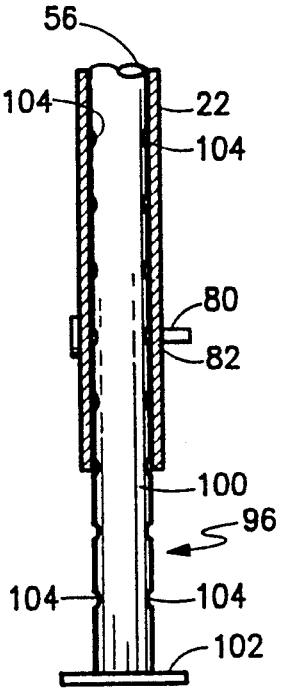
FIG. 9 is a side view in partial cross-section showing the leg structure employed with the protective structure in FIG. 8.
Figure 8:
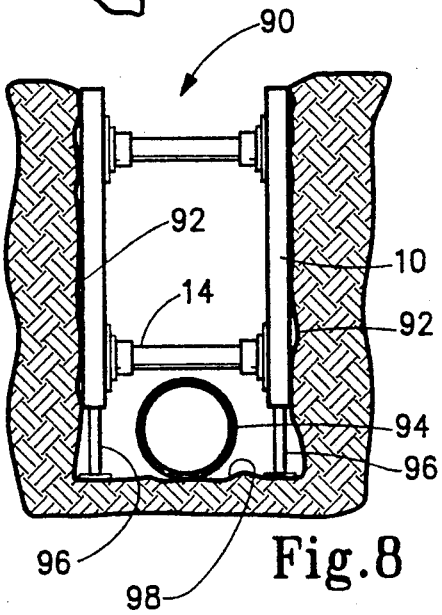
FIG. 8 is an end view in elevation showing the protective structure of FIG. 1 elevated by a leg support structure.

In order to provide sufficient clearance for pipe, piece of equipment or other mechanical structure within the excavation in situations where benches, such as benches 76, are not provided in the excavation, leg members may be mounted in each transverse rigidifying 22 in order to support the corresponding protective structure 10 in a elevated condition. Thus, as is shown in FIG. 8, a single protective structure 10 is located within trench 90 that has a pair of upright walls 92. Trench 90 has been excavated to lay a pipe 94, and, it may be seen that, to provide clearance for pipe 94, protective structure 10 is elevated by means of legs 96 so that sufficient clearance is provided between bottom wall 98 if trench 90 and the lower ones of spreader beams 14. Legs 96 are best shown in FIG. 9 where it may be seen that each leg 96 includes a tubular portion 100 that is telescopically received in cylindrical passageway 56 of each transverse rigidifying member 22. A lower foot 102 is provided at the free end of tubular portion 100, and tubular portion 100 is provided with a plurality of pairs of diametric holes 104 sized to align with holes 82 in order to receive keeper pin 80 thereby retaining each of legs 96 in a selected, adjustable extended length.

Figure 10:
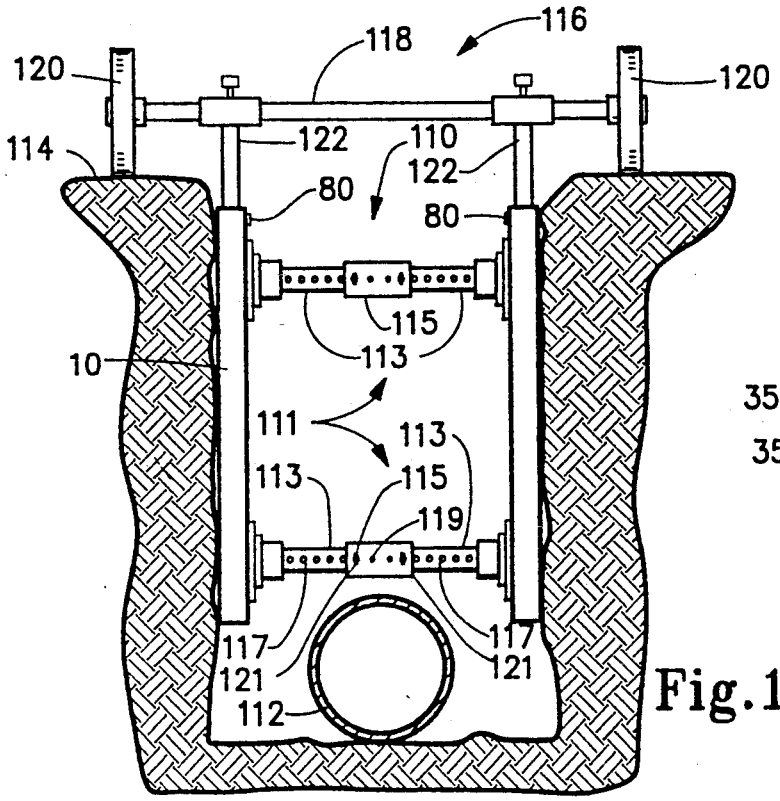
FIG. 10 is an end view of elevation showing the protective structure of FIG. 1 suspended within a trench and with mechanically adjustable spreader beams.

While it is possible to support protective structures 10 from the bottom or bench portions of exemplary trenches, it is sometimes desirable to suspend the protective structure from the ground surface. Thus, as is shown in FIG. 10, protective structure 10 is supported in a trench 110 with protective structure 10 in an elevated orientation with respect to a pipe 112 located in trench 110. Here, protective structure 10 is suspended from surface 114 of the ground by means of a carriage assembly 116 which includes an axle 118 having wheels 120 rotatably journaled at opposite ends thereof and a pair of axle supports 122 which are received on axle 118 and depend downwardly to mount to protective structure 110. Here, also, it may be noted that mechanically adjustable spreader beams 111 are used to position protective panels 12. Each spreader beam 111 has a pair of outwardly disposed insert sections 113 and a centrally located oversleeve 115 that telescopically receives insert sections 113. Diametrically opposed holes 117 and 119 are respectively provided on insert sections 113 oversleeve 115 so that insert sections 113 may be moved apart and pinned in position by pins 121. These spreader beams 111 are particularly useful in this embodiment since they allow protective panels to be moved toward one another without disconnection from spreader beams 111 or carriage 116. Then, the assembly may be relocated and protective panels 12 moved apart and into a buttressing position.

Figure 11:
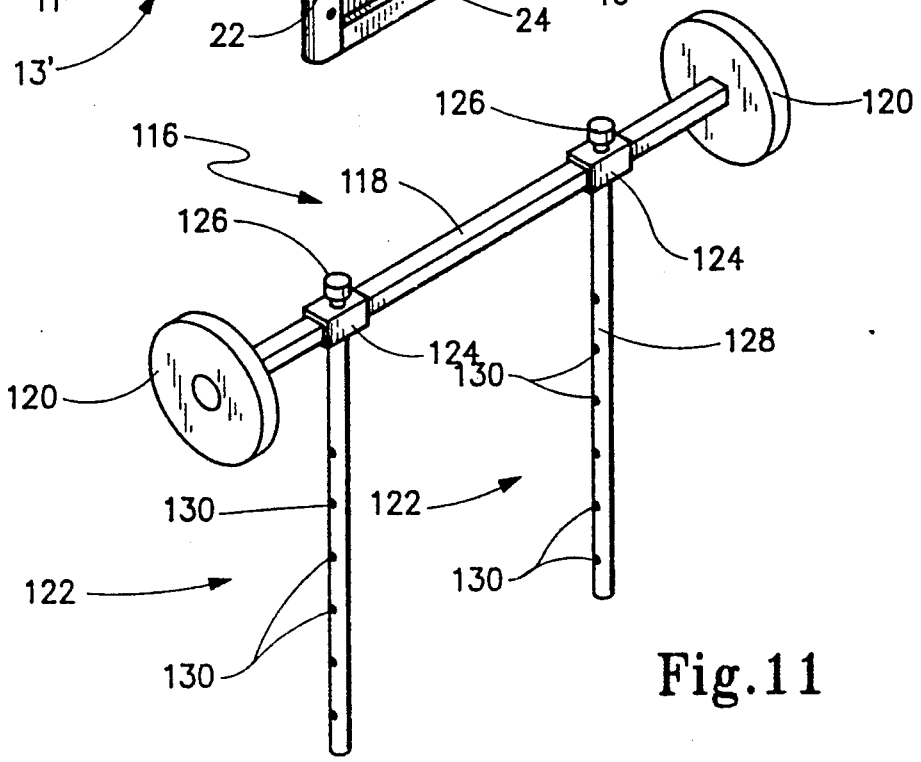
FIG. 11 is a perspective view of the carriage assembly used to suspend the protective structure shown in FIG. 10.

Carriage assembly 116 is best illustrated in FIG. 11, and it may be seen that each of axle supports 122 include a square-shaped tubular housing 124 that is slideably disposed on axle 118 which, in turn, is a square-shaped tubular section. Housings 124 are retained in position by thumb screws 126 so that the relative distance between housing 124 may be selectively adjusted. Each axle support 122 further includes a tubular extension 128 which is attached to and extends downwardly from each housing 124 so as to be telescopically received in a cylindrical passageway 156 in respective ends of the transverse rigidifying members 22. To this end, each of tubular extensions 128 have pairs of diametric holes 130 sized to align with holes 82 in the upper ends of the respective rigidifying members 122 in order to receive keeper pins 80 therethrough. Thus the distance that protective structure 10 is suspended below axle 18 may be selectively adjusted. Once suspended, protective structure 10 may be moved horizontally along trench 110 by means of wheels 120 without any need of removing protective structure 110 from the trench.

Figure 12:
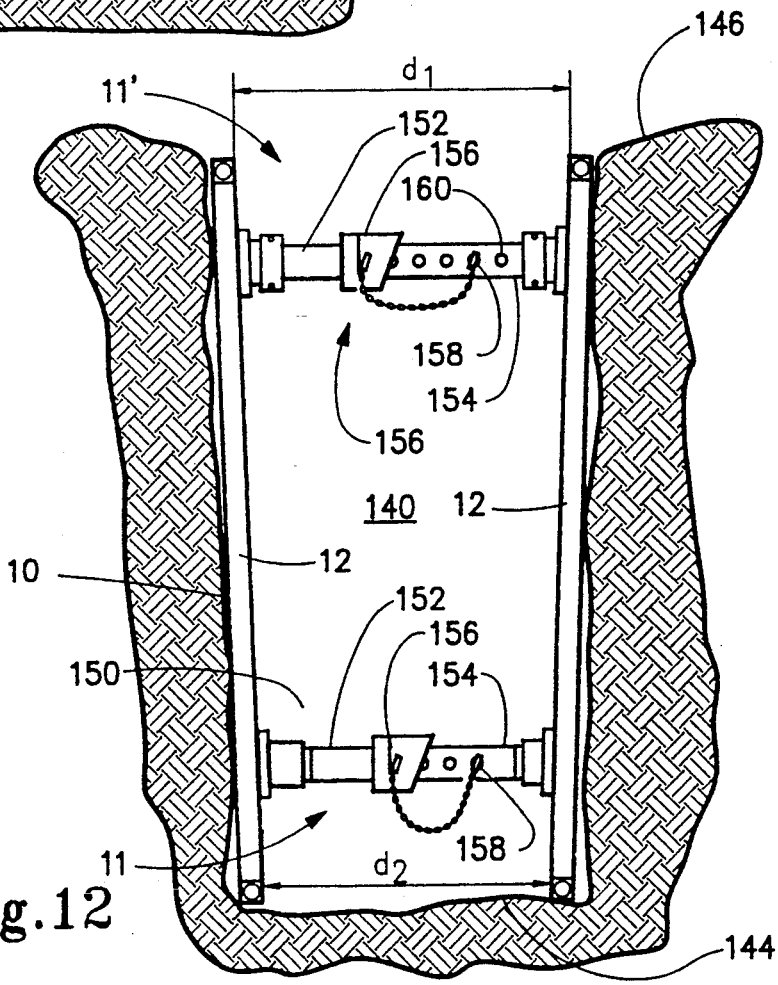
FIG. 12 is an end view in elevation showing the protective structure of FIG. 1 with an adjustable spreader beams and turned so the top and bottom of the protective structure form the ends thereof.

With reference now to FIG. 12, it may be seen that, in certain applications, it is desirable to employ the protective structure in an endwise manner. Here, it may be seen that for an excavation 140 in the form of a narrow hole, such as a manhole or other similar excavation, protective structure 10 is oriented with protective panels 12 in an abutting relationship against upright walls 142 of hole 140. Here, however, a first open end 11 is positioned against bottom 144 of hole 140 so that the opposite open end 11' is oriented upwardly adjacent to ground surface 146. When used in this manner, it is often desirable that protective panels 12 be oriented at a slight acute angle with respect to one another so that protective structure 10 is slightly "wedge-shaped". Accordingly, as is shown in FIG. 12, alternative adjustable spreader beams 150 are used. Here, each of spreader beams 150 is adjustable in effective length, and to this end, each spreader beam 150 includes a pair of telescoping members 152, 154 which may be air adjusted and locked into position by means of a retaining collar 156 and pins 158 received in diametric holes 160, as is known in the art. Thus, as it may be seen in FIG. 12, the upper open end 11' of protective structure 10 has a dimensional width "$d_1$" which is greater than the lower dimensional width "$d_2$" for open end 11 of protective structure 10.

Figure 13:
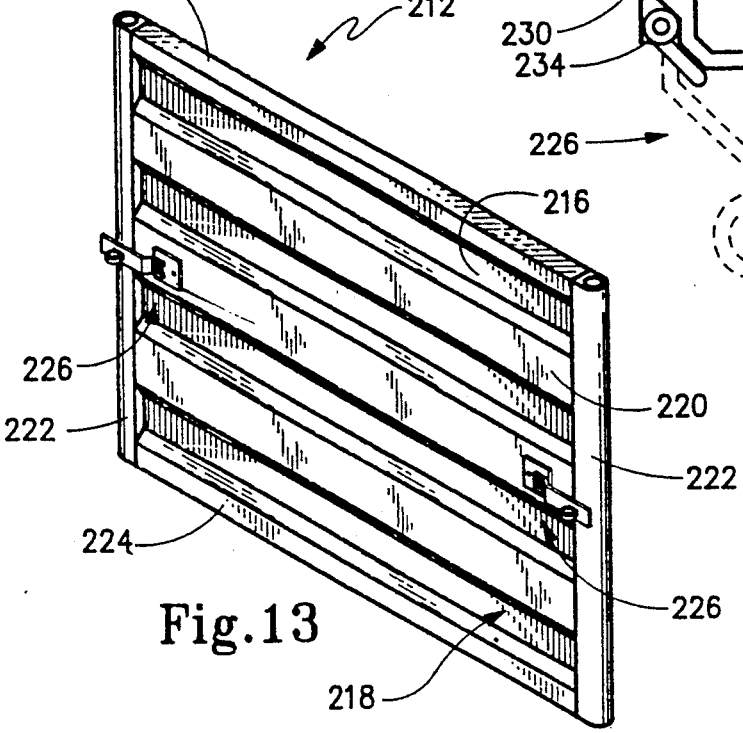
FIG. 13 is a perspective view of an according to the exemplary embodiment of the present invention.

With reference again to FIG. 1, it was noted that protective structure 10 had a pair of open ends 11 to allow a continuous pipe, conduit, or the like to pass through the protected interior space provided by protective structure 10. In some circumstances, however, it is desirable to enclose these open ends. Accordingly, an end closure panel is provide for the protective structure 10 with the construction of the end closure panel being best shown in FIGS. 13–15. In these figures, it may be seen that a representative end panel 212 is formed as a sheet 216 of corrugated material and again includes a plurality of alternating, oppositely opening channels 218 and 220. Transverse rigidifying members 222 and longitudinal rigidifying members 224 are provided to frame end panel 212 with these rigidifying members being of similar structure as that described with respect to rigidifying members 22, 24. Latch structures 226 are provided on frame end panel 212 and are each located proximate to transverse rigidifying members 222 and centrally thereof. For larger end panels multiple pairs of latch structures may be included and oriented as convenient to secure the panel to the protective structures. The preferred construction material is again aluminum for each or these structural elements.

Figure 14:
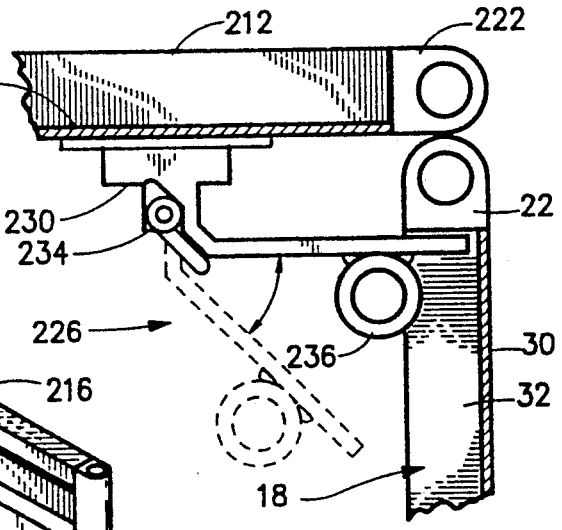
FIG. 14 is a top view in cross-section showing the latch assembly interconnecting an end panel of FIG. 1 to a protective panel of FIG. 2.

A representative latch structure 226 is best shown in FIG. 14 where it may be seen that latch structure 226 includes a latch bar 228 that is pivotally mounted to a support bracket 230 that is fastened to a wall portion 232 of end panel 212. Latch bar 228 is pivotal between a closed position, shown in FIG. 14, and an open position shown in phantom in FIG. 14. Furthermore, a spring 234 is provided to bias latch bar 228 into the closed position. A grip ring 236 is provided so that a user may conveniently manipulate latch bar 228 into the open position.

Figure 15:
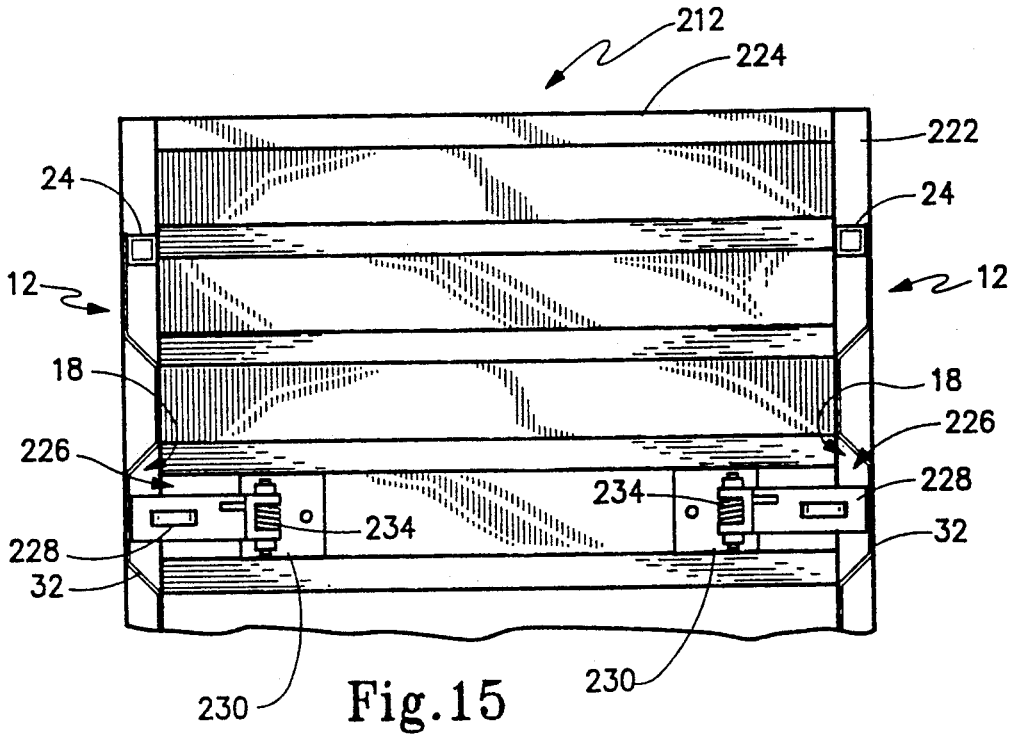
FIG. 15 is a cross-sectional view of a protective structure shown in FIG. 1 but with the end panel shown in FIG. 13 releasably secured thereto.

With reference to FIG. 15, it may be seen that end panel 212 is constructed to have a width so that, when mounted, each transverse rigidifying member 222 is adjacent to a corresponding transverse rigidifying member 22 of the opposed pair of protective panels 12. Latch structures 226 are configured so that, when latch bars 228 are in the closed position, the free ends thereof may nest within respective ones of the inwardly facing channels 18 of each protective panel 12. Furthermore, it may be appreciated that any one of the inwardly facing channels 18 may be selected to receive latch bars 228 so that, once in the closed position, latch bars 228 will be retained by side webs 32 within the selected inwardly facing channel. Thus, removal of end panel 212 is resisted by the spring loading of latch bars 228 into the closed position so that transverse rigidifying members 22 are gripped by latch structures 226 while, at the same time, vertical movement of end panel 212 is resisted by side webs 32 acting against latch bars 228.

Figure 16:
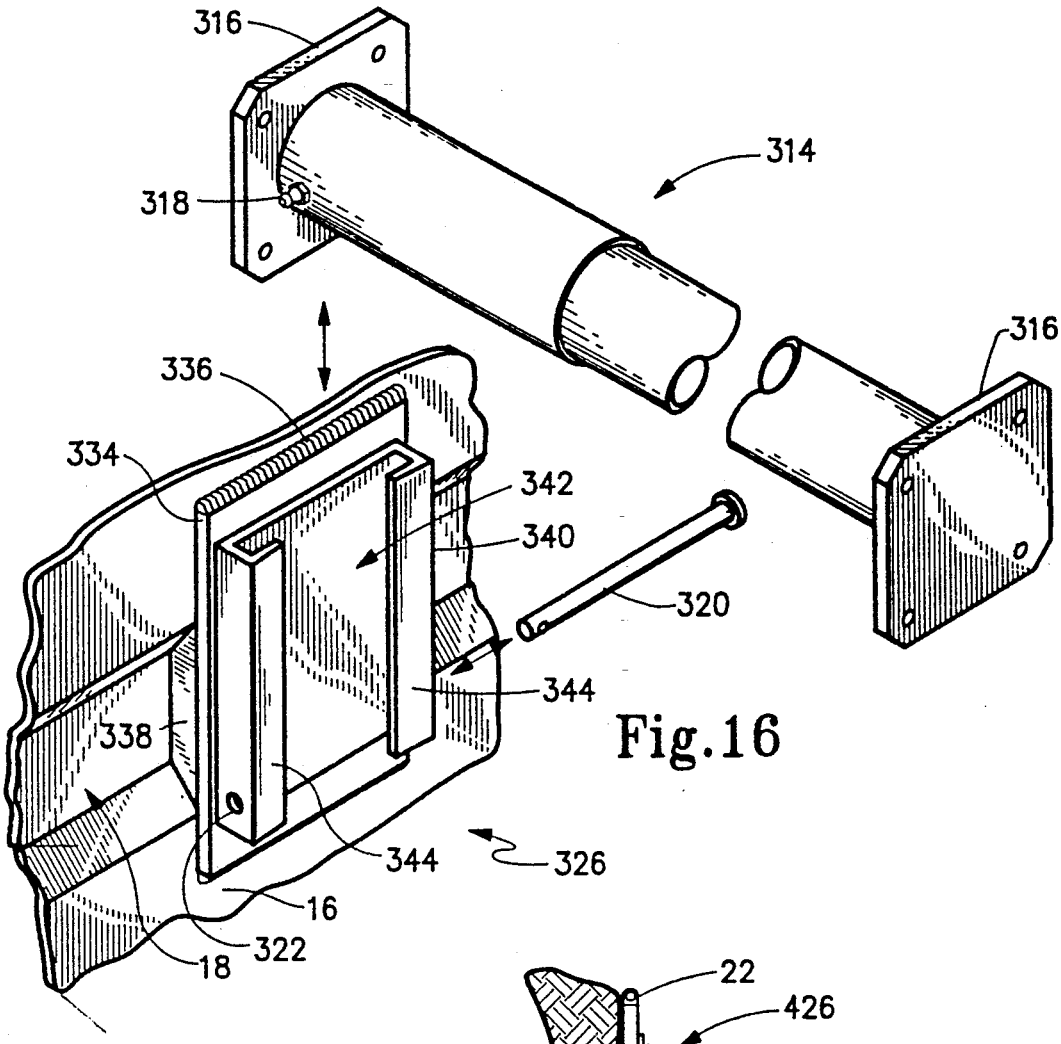
FIG. 16 shows an alternative embodiment of a mounting station used on the protective panels of the present invention for connection to an air actuated spreader beam.
Figure 17:
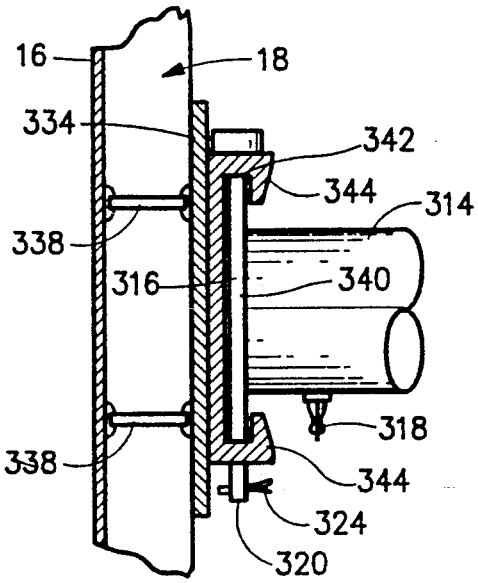
FIG. 17 is a top view in partial cross-section showing the spreader beam received in the mounting station of FIG. 16.

An alternative mounting station 326 is shown in FIGS. 16 and 17. Here, mounting station 326 has a support plate 334 that is attached by weldments 336 and that is further supported by a pair of gusset webs 338 located in inwardly facing channel 18 of sheet 16. Here, however, an adapter plate 340 is rigidly attached to support plate 334 and includes a transversely oriented slideway 342 formed by opposed shoulders 344. Slideways 342 are configured to receive an end portion, in the form of an end plate 316 of a spreader beam 314. A retaining pin 320 is provided to extend through a pair of facing holes, such as holes 322, and shoulders 344 in order to provide a limit stop that is operative to restrict the sliding movement of the end plate 316 within slideway 342. As is shown in FIG. 17, retaining pin 320 may be held in position by keeper pin 324. Furthermore, as is shown in FIGS. 16 and 17, spreader beam 314 may be a air actuated spreader beam, as is known in the art. To this end, a nipple 318 is provided for the injection of air to adjust the effective length of spreader beam 314.

Figure 18:
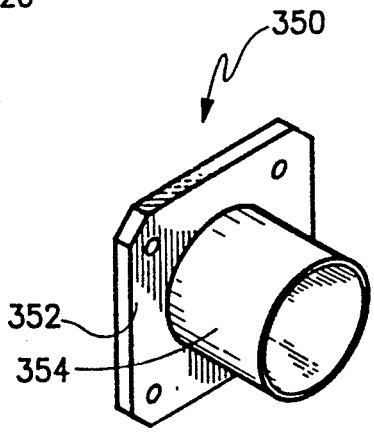
FIG. 18 is a perspective view of an auxiliary socket piece for use with the mounting station shown in FIGS. 16 and 17.

If desired, an auxiliary socket piece may be provided for use with the mounting station 326 of this alternative embodiment, and a representative example of such auxiliary socket piece is shown in FIG. 18 wherein socket piece 350 has a base plate 352 and a socket 354 attached thereto. Base plate 352 is sized correspondingly to base plate 316 of spreader base 314 so as to be readily received in slideway 342 of adapter 340. Furthermore, with reference to FIGS. 2 and 3, it may be seen that auxiliary socket piece 350 is constructed identically with the socket piece of the first embodiment of the present invention, that is, by base plate 40 and socket 42. Naturally, the ordinarily skilled person in this field of invention will recognize that other mounting stations and connectors could be employed to mount the spreader beams to the protective panels and, furthermore, that any of the variety of spreader beams known in the art could be employed with the protective panel of the present invention.

Figure 19:
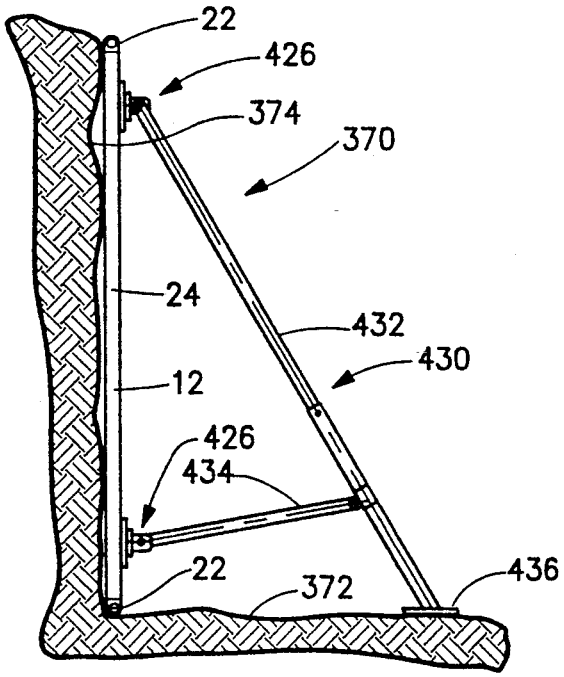
FIG. 19 is an end view in elevation showing a single protective panel according to the present invention stood on end and braced against the upright wall of an excavation.

As noted at the beginning of this disclosure, it is possible that a single protective panel be used to buttress the upright wall of an excavation. A representative implementation of a single protective panel is therefore shown in FIG. 19. Here, it may be seen that fan excavation 370 has a bottom surface 372 and an upright wall 374. Wall 374 is buttressed by a protective panel 12 oriented so that its transverse rigidifying members 22 are horizontal and longitudinal rigidifying members 24 are vertical. Mounting stations 426 are secured to protective panel 12 and a bracing assembly 430 interconnects mounting stations 426 by means of an adjustable support 432 and a cantilever member 434. Foot pad 436 is then provided to mount the brace assembly 430 against bottom surface of excavation 370.

From the foregoing, it should be understood that the present invention provides protective panels that have a high strength due to their corrugated construction and the rigidity provided by the rigidifying members, such rigidifying members 22 and 24. Nonetheless, due to the aluminum construction, the protective panels have relatively light weight in comparison with their strength so that they may be easily handled by a construction worker enabling them to be inserted and removed from a desired excavation with relative ease. In all events, the various connecting pins and their receiving holes and bores should be dimensioned to have a reasonable degree of tolerance to allow for shifting of a protective structure formed by the protective panels so that, with any limited degree, the protective panels can relatively shift with respect to one another to allow insertion between the uneven walls of a trench or other excavation and removal after use. Finally, it should now be appreciated that this assembly lends itself to a high degree of versatility in providing a protected space for workers in the construction industry.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A protective panel adapted to be supported by a brace in order to buttress an upright wall of an excavation, comprising:

(a) a corrugated sheet having lateral side edges and a pair of end edges, said sheet formed as a plurality of channels extending longitudinally between the end edges thereof with alternative ones of said channels opening oppositely one another, each channel having a bottom wall and a pair of sidewalls with adjacent one of said channels having a common sidewall therebetween;

(b) a transverse rigidifying member secured along each and edge of said sheet and operative to resist bending of said sheet; and (c) at least one mounting station disposed on a first side of said sheet and operative to mount the brace whereby said protective panel may be supported with a second side against the upright wall of the excavation, said mounting station including a support plate extending transversely across a selected channel and a gusset web interposed between said support plate and the bottom wall of the selected channel and operative to support said support plate against said bottom wall.

2. A protective panel according to claim 1 including a plurality of mounting stations disposed on the first side of said sheet.

3. A protective panel according to claim 1 including at least one handle structure disposed on the first side of said sheet.

4. A protective panel according to claim 1 wherein said mounting station includes at least two gusset webs interposed between said support plate and the bottom wall of the selected channel.

5. A protective panel according to claim 1 wherein each said transverse rigidifying member is tubular in construction and including a leg member adapted to be telescopically received therein and extend downwardly to terminate in a free ground engaging foot.

6. A protective panel according to claim 1 wherein each said transverse rigidifying member is tubular in construction and including an interconnect pin adapted to be telescopically received therein whereby two protective panels may be retained in a vertically stacked relationship with one another.

7. A protective panel according to claim 1 including a longitudinal rigidifying member secured to each lateral side edge of said sheet.

8. A protective panel according to claim 1 wherein said mounting station includes a connecting piece releasably secured to said support plate, said connecting piece adapted to mount to the brace.

9. A protective panel according to claim 1 wherein said sheet and said transverse rigidifying members are constructed of aluminum.

10. A protective structure adapted to buttress opposed upright walls of an excavation, comprising:

(a) a pair of protective panels each formed by a corrugated sheet having lateral side edges and a pair of end edges, a transverse rigidifying member secured along each end edge of said sheet and operative to resist bending of sheet and at least one mounting station disposed on a first side of said sheet, each said sheet formed as a plurality of alternating inwardly and outwardly facing channels extending longitudinally between the end edges thereof, each channel having a bottom wall and a pair of sidewalls with adjacent ones of said channels having a common sidewall therebetween and each mounting station including a support plate extending transversely across a selected inwardly opening channel and a gusset web interposed between said support plate and the bottom wall of the selected inwardly opening channel with said gusset web operative to support said support plate against said bottom wall, said protective panels adapted to be oriented in an opposed relationship such that the mounting stations on one protective panel are in opposed relation to the mounting stations on the other protective panel; and (b) a plurality of spreader beams adapted to extend between and be supported by opposed ones of said mounting stations and operative to retain said protective panels in spaced-apart relation alongside the opposed upright walls of the excavation with said protective structure having open ends, an open top and an open bottom.

11. A protective structure according to claim 10 wherein each said mounting station includes a connecting piece secured to a respective support plate, said connecting pieces adapted to mount said spreader beams between said protective panels.

12. A protective structure according to claim 11 wherein at least some of said connecting pieces are releasably secured to the respective support plate.

13. A protective structure according to claim 12 wherein said connecting pieces each include a base plate and a socket disposed on said base plate, said base plates adapted to releasably connect to said support plates such that said sockets are inwardly facing for connection to said spreader beams when said protective panels are in an opposed relation.

14. A protective structure according to claim 11 wherein said connecting pieces are formed as adapter plates each having a slideway sized and configured to slideably receive end portion of a spreader beam.

15. A protective structure according to claim 14 wherein each mounting station includes an auxiliary socket piece, each said socket piece including a base plate sized to be received in the slideway of a respective connecting piece and a socket disposed on said base plate.

16. A protective structure according to claim 14 including means associated with each of said adapter plates for providing a limit stop operative to restrict sliding movement of the end portion of the respective spreader beam.

17. A protective structure according to claim 10 including inwardly facing handle structures on each of said protective panels.

18. A protective structure according to claim 10 wherein said spreader beams are adjustable in length.

19. A protective structure according to claim 10 wherein said transverse rigidifying members are tubular in construction.

20. A protective structure according to claim 19 including leg members adapted to telescopically received in said transverse rigidifying members whereby said protective panels may be positioned and supported above a support surface.

21. A protective structure according to claim 19 including a carriage assembly adapted to be received in said transverse rigidifying members whereby said protective panels may be suspended from a support surface.

22. A protective structure according to claim 21 wherein said carriage assembly includes axle supports received in said transverse rigidifying members, an axle extending between pairs of said axle supports and oppositely disposed wheel elements rotatably supported by said axle whereby said wheel elements may engage said support surface with said protective structure suspended in said excavation.

23. A protective structure according to claim 19 including interconnect pins adapted to be received in said transverse rigidifying members whereby two of said protective structures may be stacked and fastened together by said interconnect pins.

24. A protective structure according to claim 10 wherein each said mounting station includes at least two gusset webs interposed between said support plate and the bottom wall of the selected inwardly facing channel.

25. A protective structure according to claim 10 including a longitudinal rigidifying member secured to each lateral side edge of each said sheet.

26. A protective panel adapted to be supported by a brace in order to buttress an upright wall of an excavation, comprising:

(a) a corrugated sheet lateral side edges and a pair of end edges, said sheet formed as a plurality of channels extending longitudinally between the end edges thereof with alternate ones of said channels opening oppositely one another, each channel having a bottom wall and a pair of sidewalls with adjacent ones of said channels having a common sidewall therebetween;

(b) a transverse rigidifying member secured along each end edge of said sheet; and (c) at least one mounting station disposed on a first side of said sheet in spaced relation with respect to said end edges and operative to mount the brace whereby said protective panel may be supported with a second side against the upright wall of the excavation, said mounting station including a support plate extending transversely across a selected channel and a gusset web interposed between said support plate and the bottom wall of the selected channel and operative to support said support plate against said bottom wall.

27. A protective panel adapted to be supported in an upright manner by a brace in order to buttress an upright wall of an excavation having a bottom ground surface, comprising:

(a) a corrugated sheet having lateral side edges and a pair of end edges, said sheet adapted to be oriented in an upright position when said panel is upright and formed as a plurality of channels extending longitudinally between the end edges thereof with alternate ones of said channels opening oppositely one another, each channel having a bottom wall and a pair of sidewalls with adjacent ones of said channels having a common sidewall therebetween;

(b) a tubular transverse rigidifying member secured along each end edge of said sheet;

(c) a leg member telescopically received in each said rigidifying member and downwardly depending therefrom when said panel is upright and terminating in a ground engaging foot, said leg members operative to support said panel above said bottom ground surface; and (d) at least one mounting station disposed on a first side of said sheet and operative to mount the brace whereby said protective panel may be supported with a second side against the upright wall of the excavation, said mounting station including a support plate extending transversely across a selected channel and a gusset web interposed between said support plate and the bottom wall of the selected channel and operative to support said support plate against said bottom wall.

28. A protective structure adapted to buttress opposed upright walls of an excavation, comprising:

(a) a pair of protective panels each formed by a corrugated sheet having lateral side edges and a pair of end edges, a transverse rigidifying member secured along each end edge of said sheet and at least one mounting station disposed on a first side of said sheet, each said sheet formed as a plurality of alternating inwardly and outwardly facing channels extending longitudinally between the end edges thereof, each channel having a bottom wall and a pair of sidewalls with adjacent ones of said channels having a common sidewall therebetween and each mounting station including a support plate extending transversely across a selected inwardly opening channel and a gusset web interposed between said support plate and the bottom wall of the selected inwardly opening channel with said gusset web operative to support said support plate against said bottom wall, said protective panels adapted to be oriented in an opposed relationship such that the mounting stations on one protective panel are in opposed relation to the mounting stations on the other protective panel (b) a plurality of spreader beams adapted to extend between and be supported by opposed ones of said mounting stations and operative to retain said protective panels in spaced-apart relation alongside the opposed upright walls of the excavation with said protective structure having open ends, an open top and an open bottom; and (c) at least one end panel adapted to extend between said protective panels to enclose a selected one of the open ends, said end panel including latch assemblies each including a latch bar configure to engage a selected one of the inwardly facing channels of each of the protective panels with the side webs thereof retaining said end panel in position transversely with respect to the protective panels.

29. A protective structure according to claim 28 wherein said latch bars are pivotally mounted with respect to said end panel so that said latch bars may pivot into and out of engagement with the inwardly facing channels of the protective panels.

30. A protective structure according to claim 29 wherein said latch bars are spring biased into engagement with the inwardly facing channels of the protective panels.

* * * * *